US009475079B2

(12) United States Patent
Zhu et al.

(10) Patent No.: US 9,475,079 B2
(45) Date of Patent: Oct. 25, 2016

(54) CLEANING AND DETECTION SYSTEM FOR AUTOMATIC PAINT SPRAYER

(71) Applicant: GUANGQI HONDA AUTOMOBILE CO., LTD., Guangzhou, Guangdong (CN)

(72) Inventors: Rihui Zhu, Guangzhou (CN); Songhu Li, Guangzhou (CN)

(73) Assignee: GUANGQI HONDA AUTOMOBILE CO., LTD., Guangzhou (CN)

( * ) Notice: Subject to any disclaimer, the term of this patent is extended or adjusted under 35 U.S.C. 154(b) by 116 days.

(21) Appl. No.: 14/595,235

(22) Filed: Jan. 13, 2015

(65) Prior Publication Data

US 2015/0122909 A1 May 7, 2015

Related U.S. Application Data

(63) Continuation-in-part of application No. 13/144,081, filed as application No. PCT/CN2011/071332 on Feb. 25, 2011, now abandoned.

(30) Foreign Application Priority Data

Dec. 17, 2010 (CN) ..... 2010 1 0593944

(51) Int. Cl.

| | |
|---|---|
| ***F23D 11/34*** | (2006.01) |
| ***F23D 11/38*** | (2006.01) |
| ***F23D 14/50*** | (2006.01) |
| ***B05B 15/02*** | (2006.01) |

(52) U.S. Cl.

CPC ..... *B05B 15/0266* (2013.01)

(58) Field of Classification Search

CPC ..... B05B 15/02; B05B 1/28; B05B 9/00; B05B 9/03; B05B 7/02; B05B 9/01; F23D 11/34; F23D 11/38; F23D 14/50; A62C 13/62; A62C 13/66; A62C 35/58

USPC ..... 239/112, 104, 106, 113, 124, 127, 302, 239/303, 325, 526

See application file for complete search history.

(56) References Cited

U.S. PATENT DOCUMENTS

| | | | | | |
|---|---|---|---|---|---|
| 4,487,367 | A * | 12/1984 | Perry | B05B 12/14 | 239/112 |
| 4,932,589 | A * | 6/1990 | Diana | B05B 12/14 | 118/302 |
| 2008/0023571 | A1* | 1/2008 | Heldt | B05B 5/1633 | 239/112 |
| 2009/0134241 | A1* | 5/2009 | Hoffmann | B05B 9/0403 | 239/112 |

* cited by examiner

*Primary Examiner* — Justin Jonaitis

(57) ABSTRACT

A cleaning and detection system for automatic paint sprayer is provided, comprising a compressed air supplying device, a solvent supplying device, a diaphragm pump connected to the solvent supplying device for pumping a solvent from the solvent supplying device at a predetermined pressure, and a plurality of conduits for enabling the solvent and compressed air to access to the solvent valve, triple valve and spray gun of the automatic paint sprayer for cleaning thereof. In the meantime, the solvent discharged from the sprayer is returned to the solvent supplying device for recycling. The system takes use of the working principle of the sprayer and cleans the valves and spray gun with a mixture of compressed air and solvent, achieving a perfect cleaning effect. The system can also be used to detect whether the valve core is damaged or misplaced by observing the movement and possible leakage of the valve core.

5 Claims, 8 Drawing Sheets

CLEANING AND DETECTION SYSTEM FOR AUTOMATIC PAINT SPRAYER

CROSS-REFERENCE TO RELATED APPLICATIONS

The present application is a Continuation-In-Part application of U.S. patent application Ser. No. 13/144,081, which is a national stage application of PCT application No. PCT/CN2011/071332 filed on Feb. 25, 2011, which in turn claims the benefit of Chinese patent application No. 201010593944.6 filed on Dec. 17, 2010, the contents of which are hereby incorporated by reference.

FIELD OF THE INVENTION

The present invention relates to a cleaning and detection system for automatic paint sprayer, particularly to a cleaning and detection system for triple valve, solvent valve and spray gun of the paint sprayer.

BACKGROUND OF THE INVENTION

Automatic paint sprayer is one of the most important apparatuses used in automobile painting workshop, an automatic paint sprayer usually comprises three essential components: a triple valve, a solvent valve and a spray gun. The performance of the paint sprayer directly correlates with the painting quality. However, the triple valve, solvent valve and spray gun of the paint sprayer are easily subject to failure or obstruction. Conventional technologies directly employ solvent to flush the valves and spray gun. However, these methods do not have desirable effect and it is difficult for these methods to wash off impurities such as paint sediment. In this case, when the paint sprayer is put into use again, deficiencies such as paint sediment, foreign objects, particles, solvent mark, and color mixing will adversely and significantly affect the painting quality. Disassembling and replacing the paint sprayer is very time-consuming and labor-intensive, causing a significant influence on productivity utilization.

In another aspect, conventional technologies cannot detect whether a repaired valve or spray gun will experience leaking or poor switching. Thus the condition of the paint sprayer after repairing cannot be determined prior to a trial run. Potential quality hazards may be still present even after the trial run, resulting in secondary failures. In practice, secondary failures due to valve and spray gun deficiencies account for more than 40% of total failures. The productivity utilization and production quality is thus greatly influenced. Potential safety hazards are also present.

Therefore, there is a need for a system capable of cleaning and detecting the triple valve, solvent valve and spray gun of a paint sprayer.

SUMMARY OF THE INVENTION

An object of the invention is to provide a system to clean and detect triple valve, solvent valve and spray gun of a paint sprayer. The system of the present invention is capable of both effectively cleaning and detecting, with an aim to reduce, or even obviate, the possibility of secondary failure.

In order to achieve the above object, a cleaning and detection system for automatic paint sprayer is provided, comprising a compressed air supplying device;

a solvent supplying device;

a diaphragm pump, connected to the solvent supplying device for pumping a solvent from the solvent supplying device at a predetermined pressure;

a first conduit, connected to an air output of the compressed air supplying device at a first end of the first conduit;

a multiconnector, connected to the first conduit at a second end of the first conduit, and the multiconnector having a plurality of connectors;

a third conduit, connected to a first connector of the multiconnector at a first end of the third conduit;

a second conduit, provided with a ball valve, a check valve and a pressure meter for measuring pressure inside the second conduit, the second conduit being connected to a second end of the third conduit and a first inlet of a solvent valve to be cleaned at two ends of the second conduit for providing to the solvent valve compressed air at a predetermined pressure, the check valve being located between the ball valve and the first inlet of the solvent valve;

a fourth conduit, connected to the diaphragm pump and a second inlet of the solvent valve at two ends of the fourth conduit for providing the solvent to the solvent valve, the fourth conduit being provided with another check valve;

a fifth conduit and a sixth conduit, connected to a second and third connectors of the multiconnector respectively at first ends of the fifth and sixth conduits, and to air control orifices of the solvent valves at second ends of the fifth and sixth conduits for air-controlling open and close of valve cores of the solvent valve;

a seventh conduit, an eighth conduit and a ninth conduit, connected to a fourth, fifth and sixth connectors of the multiconnector respectively at first ends of the seventh, eighth and ninth conduits, and to air control orifices of a triple valve to be cleaned at second ends of the seventh, eighth and ninth conduits for air-controlling open and close of valve cores of the triple valve;

a tenth conduit, a first end of the tenth conduit being connected to an outlet of the solvent valve, a second end of the tenth conduit being connected to two branches both connecting to the triple valve for providing to the triple valve a mixture of compressed air and solvent;

an eleventh conduit, connected to the triple valve for outputting the mixture of compressed air and solvent from the triple valve;

a twelfth conduit, connected to the eleventh conduit at a first end of the twelfth conduit, and to an inlet of a spray gun at a second end of the twelfth conduit for enabling the mixture of compressed air and solvent to access to the spray gun; and a thirteenth conduit, connected to an outlet of the spray gun for discharging the mixture of compressed air and solvent from the spray gun.

Preferably, the two branches are respectively connected to a solvent inlet and a paint inlet of the triple valve; the eleventh conduit is connected to a paint-solvent mixture outlet of the triple valve; a fourteenth conduit is connected to a waste orifice of the triple valve at one end of the fourteenth conduit, and the other end of the fourteenth conduit is connected to the solvent supplying device through a fifteenth conduit.

Preferably, the first conduit is provided with a manual pneumatic switch.

Preferably, the pressure of the compressed air provided to the solvent valve is set to be 0.35 MPa or more; and the pressure of the solvent provided to the solvent valve is set to be 0.35 MPa or more.

Preferably, the fifteenth conduit is connected to the solvent supplying device, and a filter is provided in the solvent supplying device for filtering the solvent from the fifteenth conduit for recycling.

The present invention follows the working principle of a paint sprayer and supplies the mixture of compressed air and solvent to the solvent valve, triple valve and spray gun to flush the solvent valve, triple valve and spray gun. In the meantime, by observing the movement of valve core, the operator can determine whether the valve core is damaged or misplaced. If the movement of the valve core is slowed or blocked, repair or other maintenance is required. Moreover, the quality of repairing can be evaluated by determining whether the valves and spray gun are experiencing leakage. In this way, the quality of the solvent valve, triple valve and spray gun can be evaluated off-line, without the need of trial run. Secondary failure due to deficient valve or spray gun employed in the paint sprayer can be reduced to a minimum extent.

DETAILED DESCRIPTION OF ILLUSTRATED EMBODIMENTS

The present invention will be described in detail with reference to the accompanied drawings.

Figure 1:
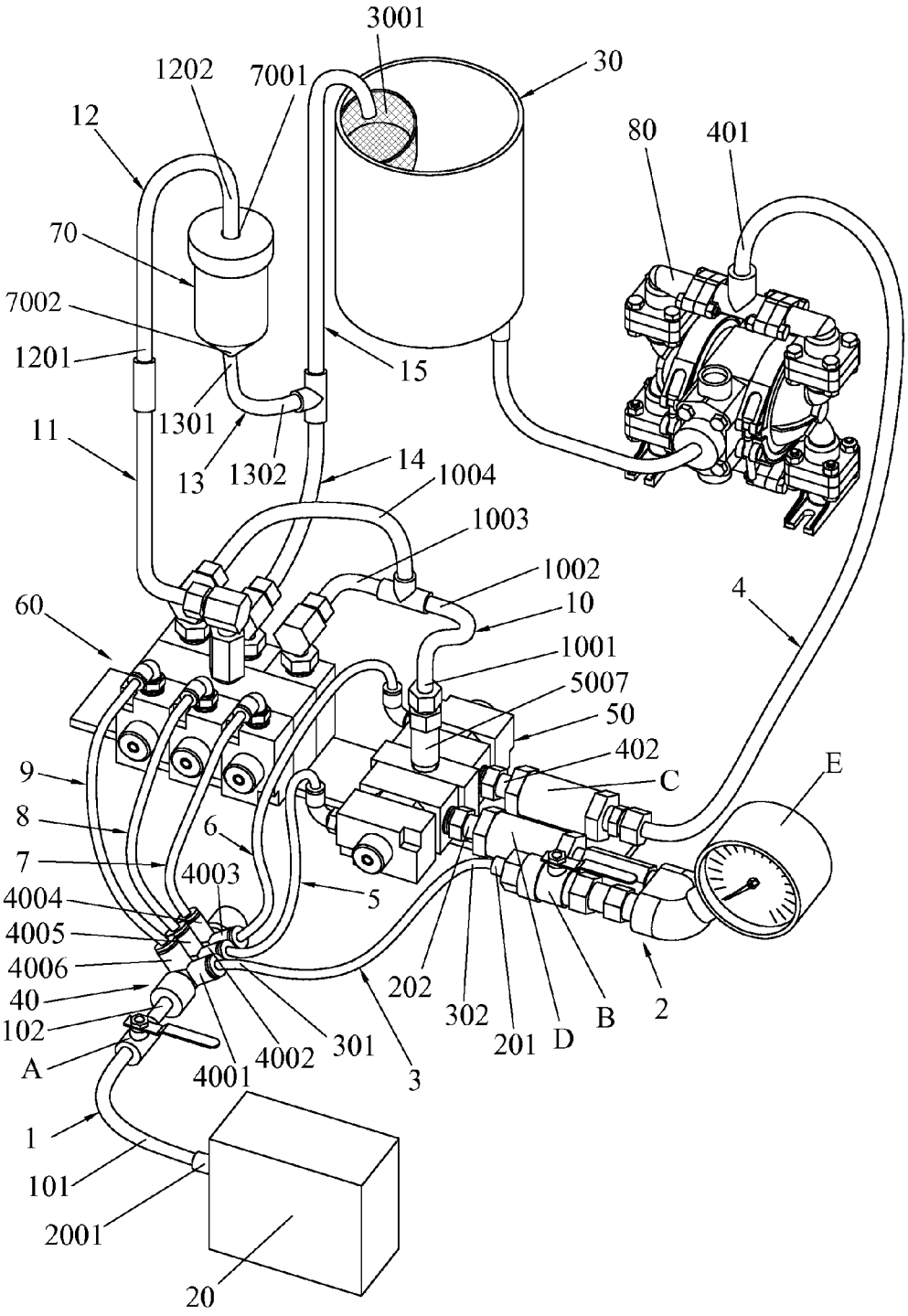
FIG. 1 is a schematic view of a cleaning and detection system for triple valve, solvent valve and spray gun of an automatic paint sprayer according to a preferable example of the present invention.
Figure 2:
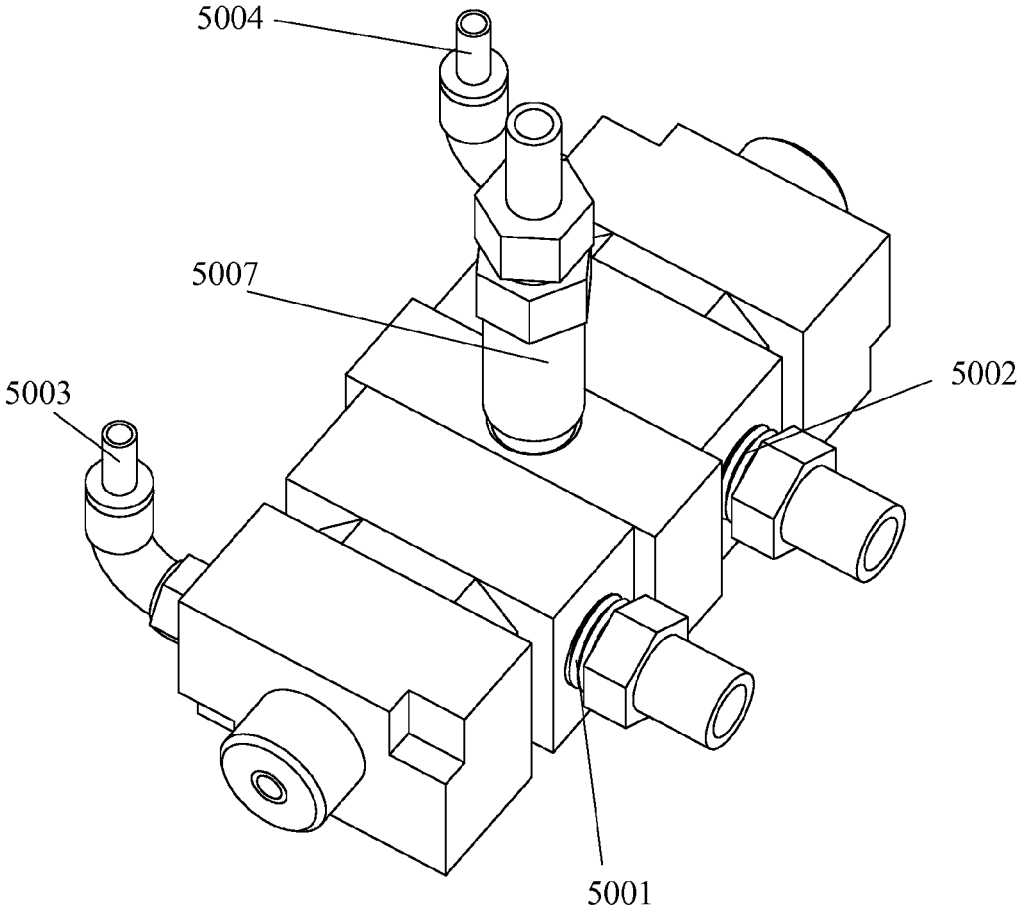
FIG. 2 is a schematic view of a solvent valve that is commonly used in painting.
Figure 3:
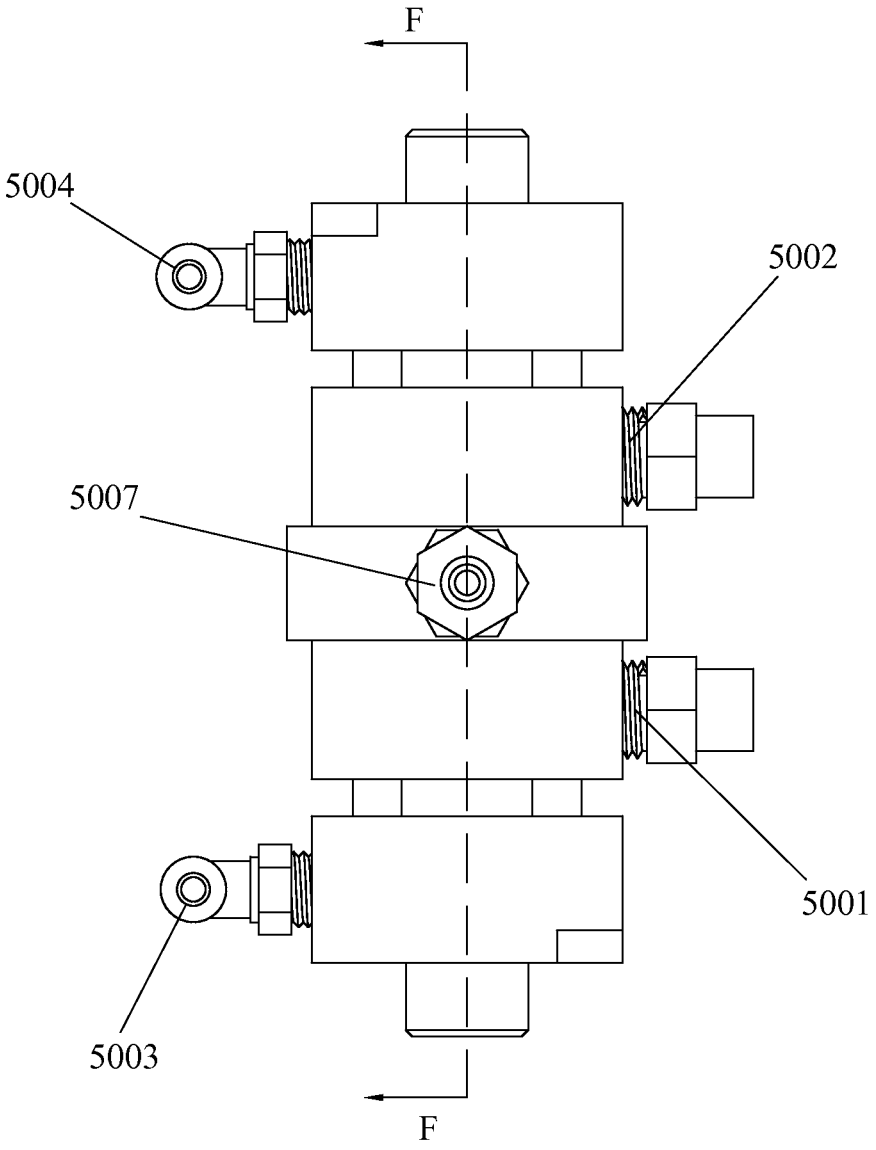
FIG. 3 is a top plan view of the solvent valve shown in FIG. 2.
Figure 4:
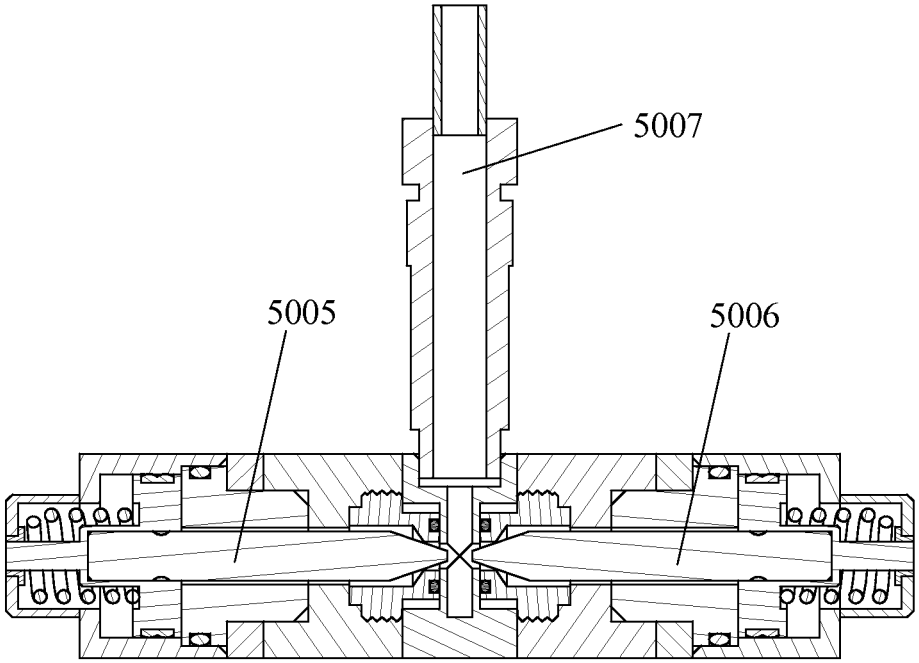
FIG. 4 is a cross sectional view taken on the line F-F of FIG. 3.

Referring to FIG. 1, the cleaning and detection system in this example comprises:

a compressed air supplying device 20, which can be any suitable compressed air supplying device conventionally used in the art;

a solvent supplying device 30, which is a solvent tank for holding a solvent in this example, a filter 3001 such as a mesh being provided in the solvent tank to filter the stream discharge from the sprayer, the filter 3001 being preferably arranged and constructed to filter out impurities and residues, and the solvent being conventional solvent used in painting techniques, such as color replacement solvent;

a diaphragm pump 80 which is connected to the solvent supplying device 30 for pumping the solvent from the solvent supplying device 30 at a predetermined pressure, the diaphragm pump 80 being replaceable by other pump, preferably made of materials not prone to generate static charge, such as plastics, in order to reduce production risk;

a first conduit 1, which is at a first end 101 connected to an air output 2001 of the compressed air supplying device 20, the first conduit 1 being preferably provided with a manual pneumatic switch A by which an air delivery can be controlled, and in a less preferable example, the manual pneumatic switch A being omitted with the air delivery control achieved by switching on/off the air supplying device 20 or by the engagement/disengagement of the first conduit 1;

a multiconnector 40, which is connected to a second end 102 of the first conduit 1, the multiconnector 40 having a plurality of connectors 4001-4006 with each connector connected to a corresponding conduit or blocked if not connected, and the multiconnector 40 having six connectors 4001-4006 in this example;

a third conduit 3, which is at a first end 301 connected to a first connector 4001 of the multiconnector 40;

a second conduit 2, which is provided with a ball valve B, a check valve D and a pressure meter E for measuring the pressure inside the conduit 2, in practice, the pressure being set as necessary by adjusting the ball valve B according to the readings on the pressure meter E, the second conduit 2 being connected at a first end 201 to a second end 302 of the third conduit 3 and at a second end 202 to a first inlet 5001 of a solvent valve 50 for supplying compressed air at a predetermined pressure to the solvent valve 50 (FIGS. 2-3), the check valve D being located between the ball valve B and the first inlet 5001 of the solvent valve 50 for preventing reflux of the solvent into the conduit 2;

a fourth conduit 4, which is connected at a first end 401 to the diaphragm pump 80 and at a second end 402 to a second inlet 5002 of the solvent valve 50 for providing the solvent to the solvent valve 50 (FIGS. 2-3), the forth conduit 4 being provided with a check valve C for preventing reflux of the solvent;

a fifth conduit 5 and a sixth conduit 6, which are respectively connected to two connectors 4002, 4003 of the multiconnector 40 at one ends, and at the other ends to two air control orifices 5003, 5004 of the solvent valve 50 for respectively air-controlling the open and close of two valve cores 5005, 5006 of the solvent valve 50 (FIGS. 2-4);

a seventh conduit 7, eighth conduit 8 and ninth conduit 9, which are respectively connected to connectors 4004, 4005, and 4006 of the multiconnector 40 at one ends, and at the other ends to air control orifices 6001, 6002, and 6003 of a triple valve 60 to be cleaned for respectively air-controlling the open and close of the valve cores 6004, 6005, 6006 of the triple valve 60 (FIGS. 5-9);

a tenth conduit 10, which is connected at a first end 1001 to an outlet 5007 of the solvent valve 50 and at a second end 1002 to two branches 1003, 1004 both connecting to the triple valve 60 for supplying a mixture of compressed air and solvent to the triple valve 60;

a eleventh conduit 11, which is connected to the triple valve 60 for discharging the mixture of compressed air and solvent from the triple valve 60;

a twelfth conduit 12, which is connected at a first end 1201 to the eleventh conduit 11, and at a second end 1202 to an inlet 7001 of a spray gun 70, for enabling the mixture of compressed air and solvent to access to the spray gun 70, then clean a spiral pipe (not shown in figure) and a trigger valve (not shown in figure) of the spray gun 70 and finally discharge from an outlet 7002 of the spray gun 70; and a thirteenth conduit 13, which is connected at a first end 1301 to the outlet 7002 of the spray gun 70 and at a second end 1302 to the solvent supplying device 30 through a fifteenth conduit 15 for recycling. The thirteenth conduit 13 may be omitted if recycling is not desirable.

Figure 5:
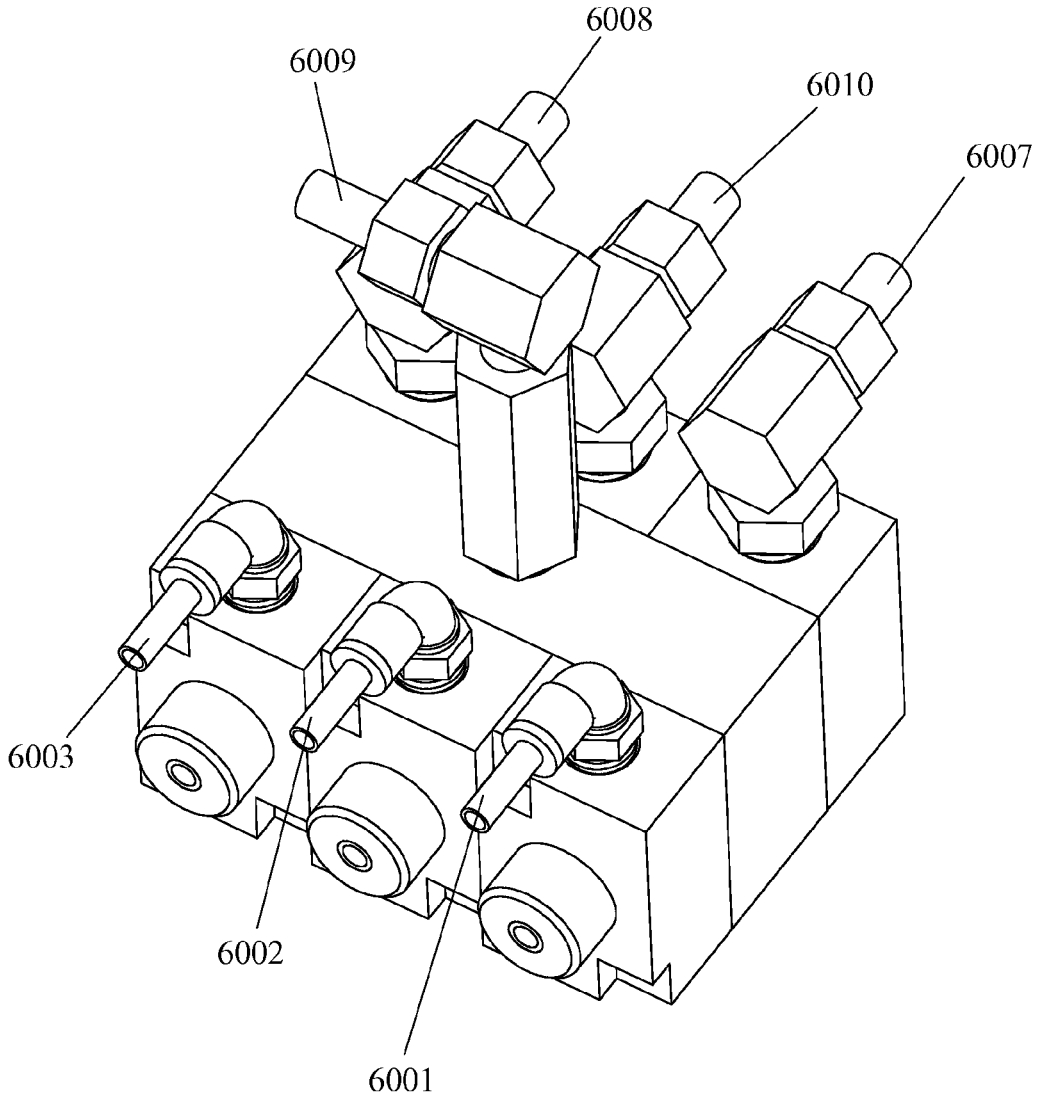
FIG. 5 is a schematic view of a triple valve that is commonly used in painting.
Figure 6:
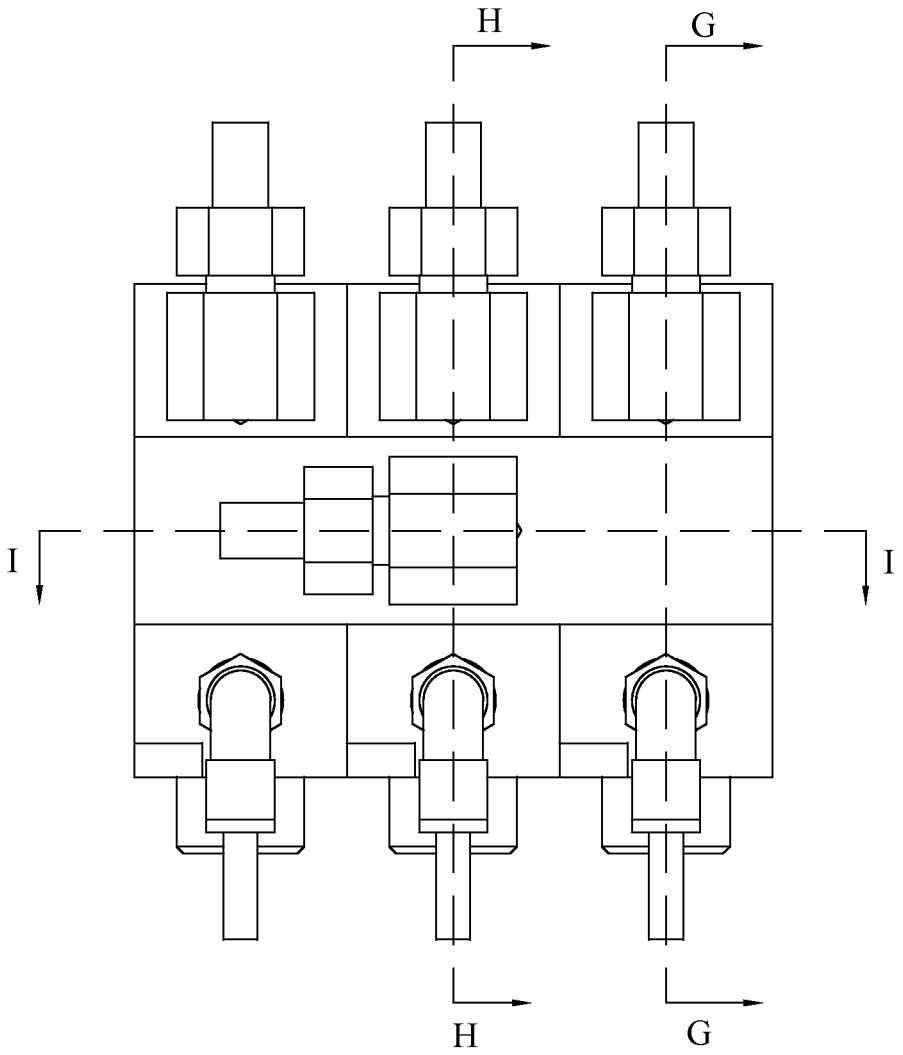
FIG. 6 is a top plan view of the triple valve shown in FIG. 5.
Figure 7:
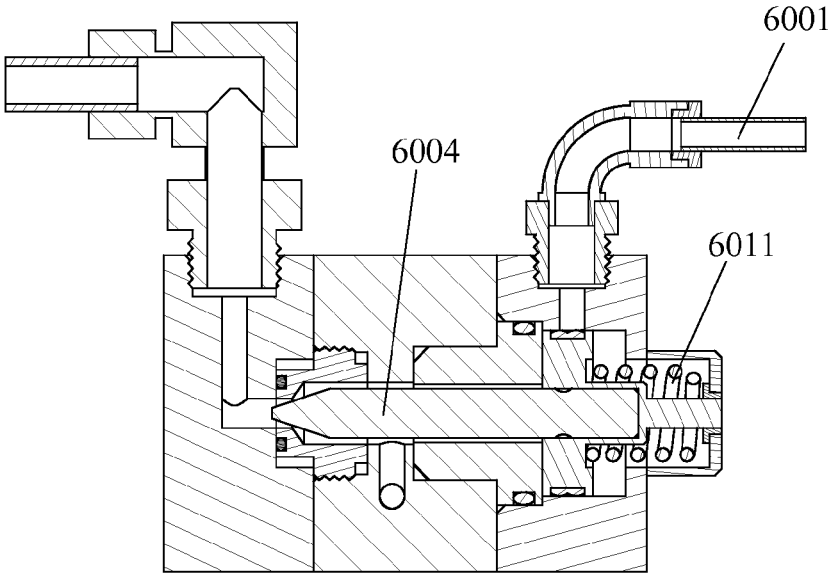
FIG. 7 is a cross sectional view taken on the line G-G of FIG. 6.
Figure 8:
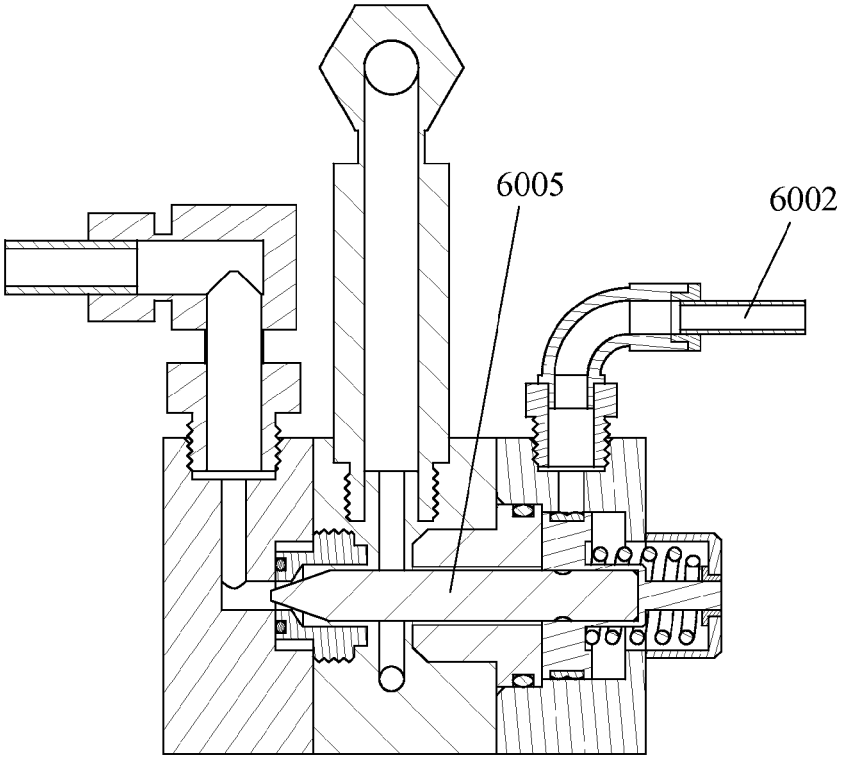
FIG. 8 is a cross sectional view taken on the line H-H of FIG. 6.
Figure 9:
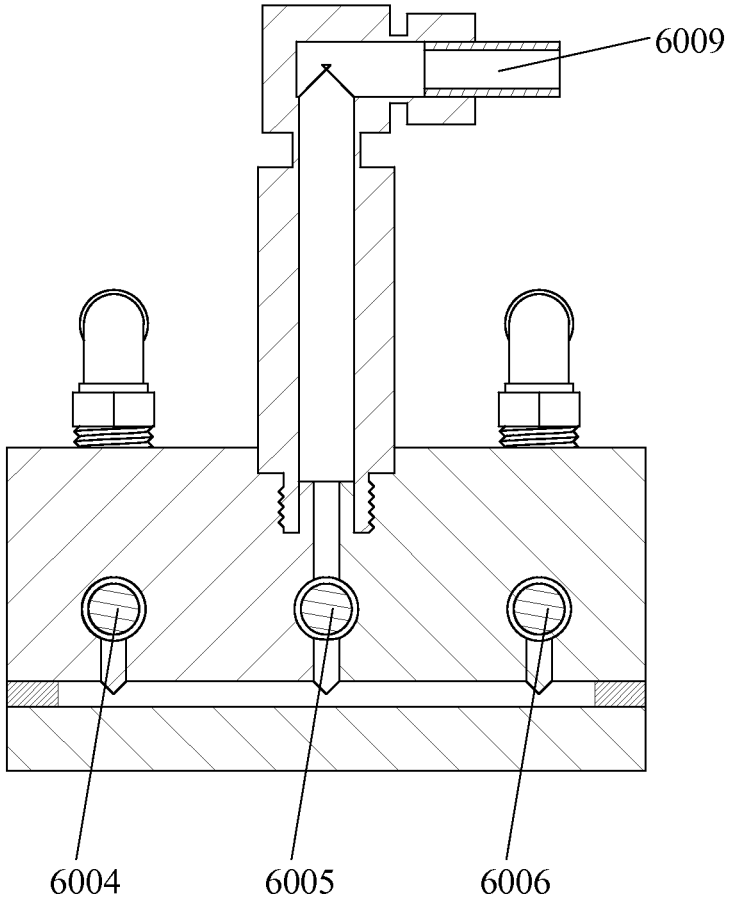
FIG. 9 is a cross sectional view taken on the line I-I of FIG. 6.

Referring to FIG. 1 and FIG. 5, in this example of the present invention, the two branches 1003, 1004 are respectively connected to a solvent inlet 6007 and a paint inlet 6008 of the triple valve 60, wherein the solvent inlet 6007 is used for letting a solvent enter the triple valve 60 during a routine painting procedure, and the paint inlet 6008 is used for letting a paint enter the triple valve 60 during a routine painting procedure. In this example of the present invention, the mixture of compressed air and solvent is rushed into the triple valve 60 through the solvent inlet 6007 and the paint inlet 6008. Correspondingly, the eleventh conduit 11 is connected to a paint-solvent mixture outlet 6009 of the triple valve 60, wherein the paint-solvent mixture outlet 6009 is used for letting a paint-solvent mixture discharge from the triple valve 60 during a routine painting procedure. In this example, the mixture of compressed air and solvent is discharged from the triple valve 60 through the paint-solvent mixture outlet 6009. In this example, a fourteenth conduit 14 is provided, one end of the fourteenth conduit 14 is connected to a waste orifice 6010 of the triple valve 60 through which the mixture of compressed air and solvent can also be discharged, and the other end of the fourteenth conduit 14 is connected to the solvent supplying device 30 through the fifteenth conduit 15.

In another example of the present invention, the conduit arrangement can be changed. Specifically, the tenth conduit 10 is connected to the paint-solvent mixture outlet 6009 of the triple valve 60 to supply the mixture of compressed air and solvent to the triple valve 60, and an additional three conduits are connected respectively to the solvent inlet 6007, paint inlet 6008 and waste orifice 6010 through which the mixture of compressed air and solvent is discharged.

In a preferable example, there is provided for the spray gun a mounting base (not shown in figure) which matches well with the spray gun for vertically placement of the spray gun to facilitate cleaning.

It can be seen that, in the above examples, the triple valve 60 and the spray gun 70 is connected in series in the flowing direction of the mixture of compressed air and solvent. Alternatively, the triple valve 60 and the spray gun 70 are connected in parallel, i.e., the spray gun 70 is directly connected to the solvent valve 50 by conduits. In the present invention, the solvent valve 50 serves as a mixing component for mixing the solvent and compressed air so as to clean the triple valve 60 and the spray gun 70. In the meantime, the solvent valve 50 per se is also cleaned.

Based on experiments, the pressure of the compressed air to be input into the solvent valve 50 is set to be 0.35 MPa or more. The pressure can be obtained by adjusting the ball valve B and read from the pressure meter E. The pressure of the solvent to be input into the solvent valve 50 is set to be 0.35 MPa or more which is an ordinary output operating pressure of the diaphragm pump 80. In practice, the pressure of the mixture of compressed air and solvent can reach as high as 0.5 MPa or more, under which it is demonstrated that the cleaning effect is more desirable. Of course, if energy consumption is not a consideration, the pressure of the compressed air can be larger, causing the pressure of the mixture of compressed air and solvent to be larger, resulting in more cleaning power. However, a pressure of 0.5 MPa is preferable.

The present system can also be used to detect the performance of the valve cores 6004, 6005, 6006 of the triple valve 60 and the performance of the valve cores 5005, 5006 of the solvent valve 50. Take the valve core 6004 for example, the valve core 6004 normally held in a closed position by a spring 6011 as indicated (FIG. 7), when only compressed air is delivered (i.e., the solvent supplying device 30 is switched off) through the air control orifice 6001, the valve core 6004 will be moved against the pressure of the spring 6011 and thus opened due to an air-pressure difference. Therefore, the movement of the valve core by accessing to and cutting off the resource of compressed air (such as by switching on and off the manual pneumatic switch A or the compressed air supplying device 20, or engagement and disengagement of the first conduit 1) can be used to evaluate the performance of the valve. Specifically, if the movement of the valve core is slow or blocked, it is considered that the valve is not cleaned completely or the valve core is damaged or misplaced. In this case, the valve cannot be put into use and should be removed for further inspection, in order to determine whether it can be repaired or should be discarded.

In addition, the present system can also be used to determine whether the valves and the spray gun are experiencing leakage. When only the solvent is delivered (the valve cores will not be opened), the performance of the valve and valve core (leakage and damage) can be determined by detecting whether there is a leakage at an output conduit of the valve, and the performance of the spray gun (leakage) can be determined by switching off the trigger valve of the spray gun and detecting whether there is a leakage at the outlet of the spray gun. If leakage is detected, the valves and spray gun used in the system should be removed for further inspection, in order to determine whether they can be repaired or should be discarded.

The above description is made with reference to preferable examples of the present invention and should not be a limiting of the invention. Any equivalent changes or modifications made based on the present invention should be included in the scope of the present invention.

What is claimed is:

1. A cleaning system for automatic paint sprayer, comprising a compressed air supplying device;

a solvent supplying device;

a diaphragm pump, connected to the solvent supplying device for pumping a solvent from the solvent supplying device at a predetermined pressure;

a first conduit, connected to an air output of the compressed air supplying device at a first end of the first conduit;

a multiconnector, connected to the first conduit at a second end of the first conduit, and the multiconnector having a plurality of connectors;

a third conduit, connected to a first connector of the multiconnector at a first end of the third conduit;

a second conduit, provided with a ball valve, a check valve and a pressure meter for measuring pressure inside the second conduit, the second conduit being connected to a second end of the third conduit and a first inlet of a solvent valve to be cleaned at two ends of the second conduit for providing to the solvent valve compressed air at a predetermined pressure, the check valve being located between the ball valve and the first inlet of the solvent valve;

a fourth conduit, connected to the diaphragm pump and a second inlet of the solvent valve at two ends of the fourth conduit for providing the solvent to the solvent valve, the fourth conduit being provided with another check valve;

a fifth conduit and a sixth conduit, connected to a second and third connectors of the multiconnector respectively at first ends of the fifth and sixth conduits, and to air control orifices of the solvent valves at second ends of the fifth and sixth conduits for air-controlling open and close of valve cores of the solvent valve;

a seventh conduit, an eighth conduit and a ninth conduit, connected to a fourth, fifth and sixth connectors of the multiconnector respectively at first ends of the seventh, eighth and ninth conduits, and to air control orifices of a triple valve to be cleaned at second ends of the seventh, eighth and ninth conduits for air-controlling open and close of valve cores of the triple valve;

a tenth conduit, a first end of the tenth conduit being connected to an outlet of the solvent valve, a second end of the tenth conduit being connected to two branches both connecting to the triple valve for providing to the triple valve a mixture of compressed air and solvent;

an eleventh conduit, connected to the triple valve for outputting the mixture of compressed air and solvent from the triple valve;

a twelfth conduit, connected to the eleventh conduit at a first end of the twelfth conduit, and to an inlet of a spray gun at a second end of the twelfth conduit for enabling the mixture of compressed air and solvent to access to the spray gun; and a thirteenth conduit, connected to an outlet of the spray gun for discharging the mixture of compressed air and solvent from the spray gun.

2. The cleaning system for automatic paint sprayer of claim 1, wherein the two branches are respectively connected to a solvent inlet and a paint inlet of the triple valve; the eleventh conduit is connected to a paint-solvent mixture outlet of the triple valve; a fourteenth conduit is connected to a waste orifice of the triple valve at one end of the fourteenth conduit, and the other end of the fourteenth conduit is connected to the solvent supplying device through a fifteenth conduit.

3. The cleaning system for automatic paint sprayer of claim 1, wherein the first conduit is provided with a manual pneumatic switch.

4. The cleaning system for automatic paint sprayer of claim 1, wherein the pressure of the compressed air provided to the solvent valve is set to be 0.35 MPa or more; and the pressure of the solvent provided to the solvent valve is set to be 0.35 MPa or more.

5. The cleaning system for automatic paint sprayer of claim 2, wherein the fifteenth conduit is connected to the solvent supplying device, and a filter is provided in the solvent supplying device for filtering the solvent from the fifteenth conduit for recycling.

* * * * *